US005252149A

United States Patent [19]

Dolman

[11] Patent Number: 5,252,149

[45] Date of Patent: Oct. 12, 1993

[54] FERROCHROMIUM ALLOY AND METHOD THEREOF

[75] Inventor: Kevin F. Dolman, Helena Valley, Australia

[73] Assignee: Warman International Ltd., Artarmon, Australia

[21] Appl. No.: 15,878

[22] Filed: Feb. 10, 1993

Related U.S. Application Data

[63] Continuation of Ser. No. 671,885, Apr. 3, 1991, abandoned.

[30] Foreign Application Priority Data

Aug. 4, 1989 [AU] Australia ..... PJ5628

[51] Int. Cl.[5] ..... C22C 38/36; C21D 6/00

[52] U.S. Cl. ..... 148/605; 148/422; 148/324; 148/611; 148/707

[58] Field of Search ..... 420/442, 11, 12; 148/605, 611, 707

[56] References Cited

U.S. PATENT DOCUMENTS

| | | | |
|---|---|---|---|
| 3,086,858 | 4/1963 | Edminster | 420/12 |
| 3,690,956 | 9/1972 | Thompson | 148/324 |
| 4,043,842 | 8/1977 | Joiret | 148/324 |
| 4,043,844 | 8/1977 | Feltz | 148/324 |

FOREIGN PATENT DOCUMENTS

| | | |
|---|---|---|
| 63734 | 3/1967 | Australia . |
| 12869 | 4/1968 | Australia . |
| 14453 | 4/1970 | Australia . |
| 43163 | 6/1972 | Australia . |
| 220006 | 12/1923 | United Kingdom . |
| 362375 | 11/1931 | United Kingdom . |
| 401644 | 12/1933 | United Kingdom . |

OTHER PUBLICATIONS

Derwent Abstract, Week W1, Class M27, SU 414326 (Dolbenko) Jul. 19, 1974.

Derwent Abstract Accession No. 61284X/32, Class M27, SU 489808 Feb. 4, 1976.

*Primary Examiner*—Deborah Yee

*Attorney, Agent, or Firm*—Kerkam, Stowell, Kondracki & Clarke

[57] ABSTRACT

An erosion and corrosion resistant ferrochromium alloy comprising the following composition, in wt. %, 34–50 chromium, 1.5–2.5 carbon, up to 5 manganese, up to 5 silicon, up to 5 molybdenum, up to 10 nickel, up to 5 copper, up to 1% of each of one or more micro-alloying elements selected from the group consisting of titanium, zirconium, niobium, boron, vanadium and tungsten, and balance, iron and incidental impurities.

The alloy has a microstructure comprising eutectic chromium carbides in a matrix comprising one or more of ferrite, retained austenite and martensite, as herein defined. Optionally, the microstructure further comprises one of primary chromium carbides, primary ferrite or primary austenite in the matrix.

12 Claims, 5 Drawing Sheets

OPTICAL MICROGRAPH MAG. X 420

CHEMICAL ANALYSIS:

| Cr | C | Mn | Si | Mo | Ni | Cu | Fe |
|---|---|---|---|---|---|---|---|
| 43.0 | 2.02 | 0.92 | 1.44 | 1.88 | 1.92 | 1.20 | bal |

OPTICAL MICROGRAPH MAG. X 300

CHEMICAL ANALYSIS:

| Cr | C | Mn | Si | Mo | Ni | Cu | Fe |
|---|---|---|---|---|---|---|---|
| 28.4 | 1.94 | 0.97 | 1.48 | 2.10 | 2.01 | 1.49 | bal |

OPTICAL MICROGRAPH MAG.X 300

CHEMICAL ANALYSIS:

| Cr | C | Mn | Si | Mo | Ni | Cu | Fe |
|---|---|---|---|---|---|---|---|
| 35.8 | 1.95 | 0.96 | 1.48 | 2.00 | 2.04 | 1.48 | bal |

OPTICAL MICROGRAPH MAG. X 300

CHEMICAL ANALYSIS:

| Cr | C | Mn | Si | Mo | Ni | Cu | Fe |
|---|---|---|---|---|---|---|---|
| 40.0 | 1.92 | 0.96 | 1.59 | 1.95 | 1.95 | 1.48 | bal |

OPTICAL MICROGRAPH MAG. X 300

CHEMICAL ANALYSIS:

| Cr | C | Mn | Si | Mo | Ni | Cu | Fe |
|---|---|---|---|---|---|---|---|
| 40.0 | 2.30 | 2.77 | 1.51 | 2.04 | 1.88 | 1.43 | bal |

OPTICAL MICROGRAPH MAG. X 420

CHEMICAL ANALYSIS:

| Cr | C | Mn | Si | Mo | Ni | Cu | Fe |
|---|---|---|---|---|---|---|---|
| 43.0 | 2.02 | 0.92 | 1.44 | 1.88 | 1.92 | 1.20 | bal |

FERROCHROMIUM ALLOY AND METHOD THEREOF

This is a continuation of application Ser. No. 07/671,885, filed Apr. 3, 1991, now abandoned.

The present invention relates to a ferrochromium alloy and more particularly to an erosion and corrosion resistant ferrochromium alloy.

The present invention is designed for use in the formation of parts for lining pumps, pipes, nozzles, mixers and similar devices which, in service, can be subjected to mixtures containing a corrosive fluid and abrasive particles.

Typical applications for such parts include flue gas desulphurization, in which the parts are exposed to sulphuric acid and limestone, and fertiliser production, in which the parts are exposed to phosphoric acid, nitric acid and gypsum.

U.S. Pat. Nos. 4,536,232 and 4,080,198, assigned to Abex Corporation (the "Abex U.S. patents"), disclose ferrochromium alloys containing approximately 1.6 wt. % carbon and 28 wt. % chromium which are characterized by primary chromium carbide and ferrite islands in a martensite or austenite matrix containing a solid solution of chromium. The level of chromium in the alloys suggests that the alloys should exhibit good corrosion resistance characteristics. However, the performance of such alloys from the corrosion resistance viewpoint is not entirely satisfactory.

An object of the present invention is to provide a ferrochromium alloy which has improved erosion and corrosion resistance compared with the alloys disclosed in the Abex U.S. patents.

The mechanism for erosion and corrosion of alloys of the type disclosed in the Abex U.S. patents in acidic environments is by accelerated corrosion due to the continuous removal of the passive corrosion-resistant layer by erosive particles in the fluid stream.

In order to replenish the passive layer it is necessary to have the chromium concentration at as high a level as possible in the matrix.

However, simply increasing the chromium content to improve corrosion resistance tends to cause the formation of the sigma phase which is undesirable in view of the embrittlement problems associated with the sigma phase.

DETAILED DESCRIPTION OF THE PREFERRED EMBODIMENTS

Figure 1:
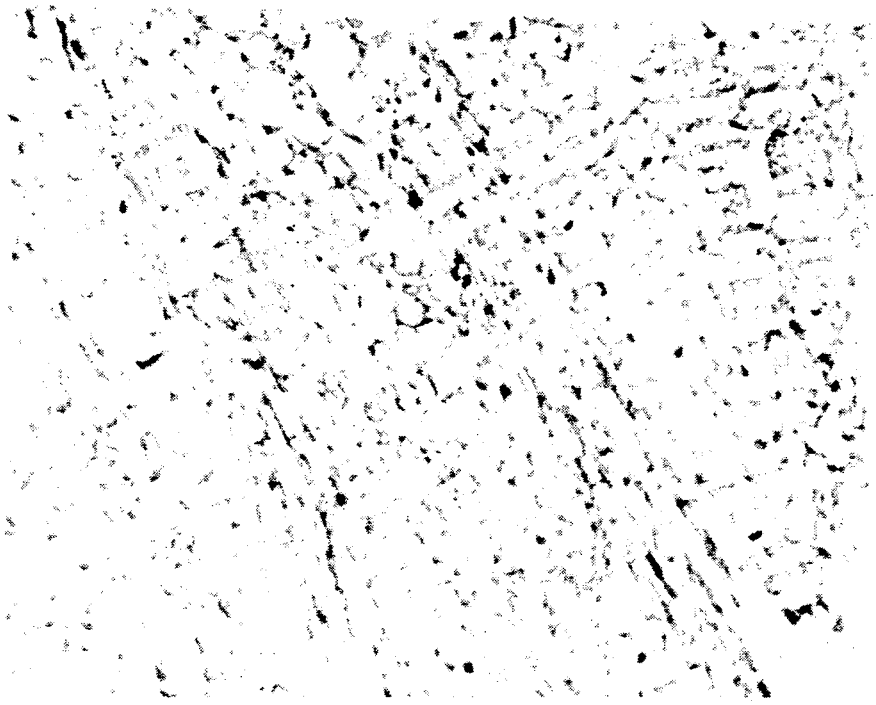
FIG. 1 is a photomicrograph of the microstructure of an Abex alloy.

The present invention is based on the realization that by increasing both the chromium and carbon concentrations of alloys of the type disclosed in the Abex U.S. patents it is possible to increase the volume fraction of the chromium carbide phase, and thereby improve the wear resistance characteristics of the ferrochromium alloys, while maintaining the matrix at a chromium concentration which is at a level that will not lead to the formation of significant amounts of sigma phase. It can be appreciated that by improving the wear resistance of the ferrochromium alloys, in view of the mechanism by which erosion and corrosion occurs, as noted above, it is possible to realize an improvement in the erosion and corrosion resistance of the ferrochromium alloys.

According to the present invention there is provided an erosion and corrosion resistant ferrochromium alloy comprising the following composition, in wt. %.

34–50 chromium
1.5–2.5 carbon
up to 5 manganese
up to 5 silicon
up to 5 molybdenum
up to 10 nickel
up to 5 copper
up to 1% of each of one or more micro-alloying elements selected from the group consisting of titanium, zirconium, niobium, boron, vanadium and tungsten, and
balance, iron and incidental impurities, with a microstructure comprising eutectic chromium carbides in a matrix comprising one or more of ferrite, retained austenite and martensite, as herein defined.

The term "ferrite" is herein understood to mean body-centred cubic iron (in the alpha and/or delta forms) containing a solid solution of chromium.

The term "austenite" is herein understood to mean face-centred cubic iron containing solid solutions of carbon and chromium.

The term "martensite" is herein understood to mean a transformation product of austenite.

It is preferred that the matrix contains a 25–35 wt. % solid solution of chromium.

It is preferred that the microstructure further comprises one of primary chromium carbides, primary ferrite or primary austenite in the matrix.

The preferred amount in wt %. of the elements chromium, carbon, manganese, silicon, molybdenum, nickel and copper is as follows:

36–40 chromium
1.9–2.1 carbon
1–2 manganese
0.5–1.5 silicon
1–2 molybdenum
1–5 nickel
1–2 copper With the foregoing preferred composition it is preferred that the matrix contains a 29–32 wt. % solid solution of chromium.

In accordance with the invention, increasing both the chromium and carbon contents of the ferrochromium alloy above the levels disclosed in the Abex U.S. patents permits the formation of a greater volume fraction of hard carbides to enhance wear resistance. More specifically, and preferably, a stoichiometric balance in the increase in chromium and carbon contents permits the formation of a greater volume fraction of chromium carbides without increasing the chromium content of the matrix to a critical level above which sigma phase embrittlement occurs.

It has been found that preferred alloys of the present invention exhibit superior corrosion and erosion resistance to the alloys disclosed in the Abex U.S. patents. This is illustrated in Table 1 below which lists the results of laboratory scale potentiodynamic corrosion and disc wear tests on alloys disclosed in the Abex U.S. patents and preferred alloys of the present invention. The compositions of the alloys are listed in Table 2 below.

TABLE 1

| Corrosion and Erosion Test Results | Corrosion* (mm/yr) | Erosion** ($mm^3$/hr) |
|---|---|---|
| ABEX Alloy #1 | 5.60 | 488 |
| ABEX Alloy #2 | 2.50 | 614 |
| Casting #1 | 0.07 | 370 |
| Casting #2 | 0.43 | 444 |

*10% Sulphuric Acid, 25° C. to ASTM G61
**40 weight % Silica Sand Slurry @ 18 m/s

TABLE 2

| Composition of Alloys of Table 1 | Cr | C | Mn | Si | Mo | Ni | Cu | Fe |
|---|---|---|---|---|---|---|---|---|
| ABEX Alloy #1* | 28.4 | 1.94 | 0.97 | 1.48 | 2.10 | 2.01 | 1.49 | Bal |
| ABEX Alloy #2** | 27.5 | 1.65 | 1.21 | 1.47 | 2.00 | 2.00 | 1.39 | Bal |
| Casting #1 | 35.8 | 1.95 | 0.96 | 1.48 | 2.10 | 2.04 | 1.48 | Bal |
| Casting #2 | 40.0 | 1.92 | 0.96 | 1.59 | 1.95 | 1.95 | 1.48 | Bal |

*As-cast alloy with composition within range of U.S. Pat. No. 4,536,232
**Heat treated alloy with composition within range of U.S. Pat. No. 4,536,232

It will be noted from Table 1 that the corrosion and erosion resistance of the preferred alloys of the present invention is significantly better than that of the Abex alloy.

The alloy of the present invention has a different microstructure to that of the alloys disclosed in the Abex U.S. patents. The difference is illustrated in the accompanying figures which comprise photocopies of photomicrographs of an alloy disclosed in the Abex U.S. patents and preferred alloys of the present invention.

FIG. 1 shows the microstructure of an Abex alloy which comprises 28.4% chromium, 1.94% carbon, 0.97% manganese, 1.48% silicon, 2.10% molybdenum, 2.01% nickel and 1.49% copper, the balance substantially iron. The microstructure consists of primary austenite dendrites (50% volume) and a eutectic structure comprising eutectic carbides in a matrix of eutectic ferrite, retained austenite and martensite.

Figure 2:
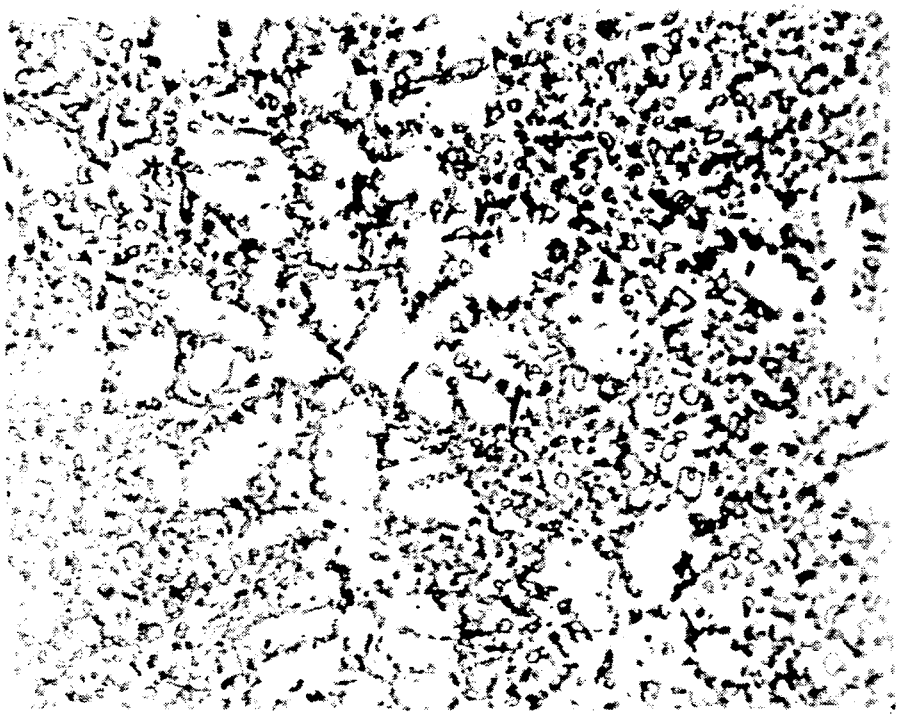
FIG. 2 is a photomicrograph of one preferred alloy of the present invention.

FIG. 2 shows the microstructure of one preferred alloy of the present invention which comprises 35.8% chromium, 1.94% carbon, 0.96% manganese, 1.48% silicon, 1.94% carbon, 0.96% manganese, 1.48% silicon, 2.06% molybdenum, 2.04% nickel, 1.48% copper, the balance substantially iron. The microstructure is hypereutectic with primary ferrite dendrites (20% volume) and a eutectic structure comprising finely dispersed eutectic carbides in a matrix of eutectic ferrite. It is noted that when compared with the microstructure of the Abex U.S. patent shown in FIG. 1 the microstructure of FIG. 2 reflects that there is a reduced volume of primary dendrites and an increased volume of the eutectic matrix and since the eutectic matrix has a relatively high proportion of carbides there is an overall increase in the volume fraction of hard carbides in the alloy when compared with the Abex alloy. It is noted that the foregoing phenomenon is also apparent to a greater extent from a comparison of the microstructures shown in FIGS. 3 to 5 and FIG. 1.

Figure 3:
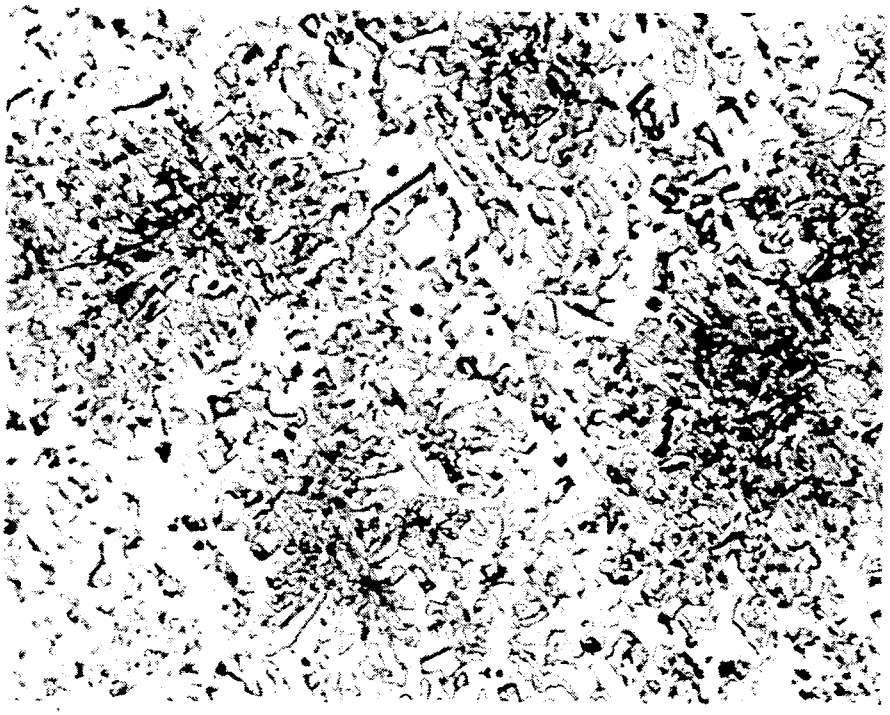
FIG. 3 is a photomicrograph of another preferred alloy of the present invention.

FIG. 3 shows the microstructure of another preferred alloy of the present invention which comprises 40.0% chromium, 1.92% carbon, 0.96% manganese, 1.59% silicon, 1.95% molybdenum, 1.95% nickel, 1.48% copper, the balance substantially iron. The microstructure consists of eutectic carbides in a matrix of eutectic ferrite.

Figure 4:
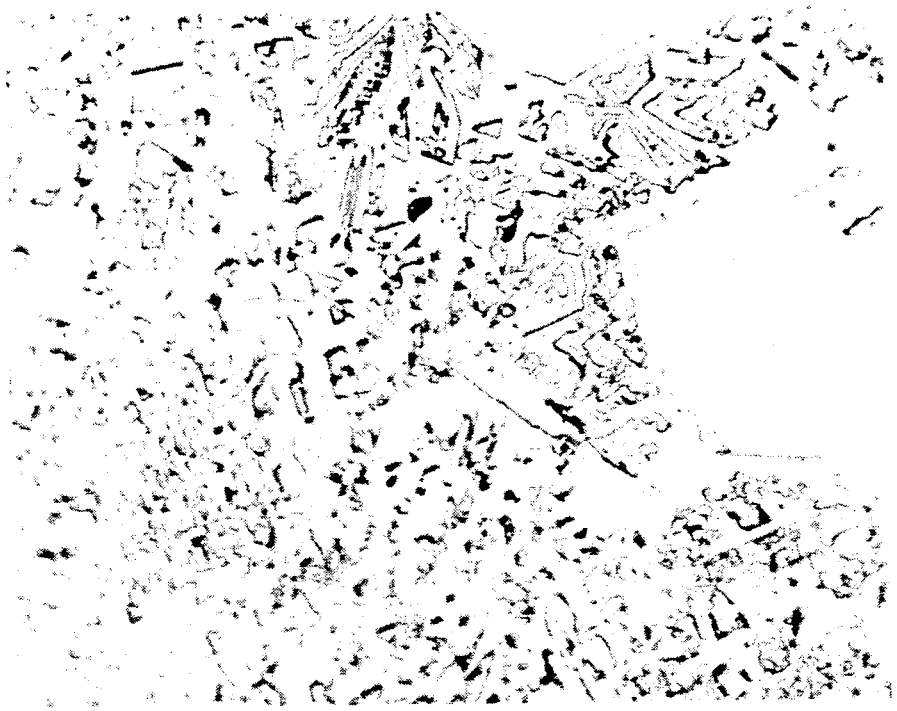
FIG. 4 is a photomicrograph of another preferred alloy of the present invention.

FIG. 4 shows the microstructure of another preferred alloy of the present invention which comprises 40.0% chromium, 2.30% carbon, 2.77% manganese, 1.51% silicon, 2.04% molybdenum, 1.88% nickel, 1.43% copper, the balance substantially iron. The microstructure is hypereutectic with primary $M_7C_3$ carbides and a eutectic structure comprising eutectic carbides in a matrix of eutectic ferrite.

Figure 5:
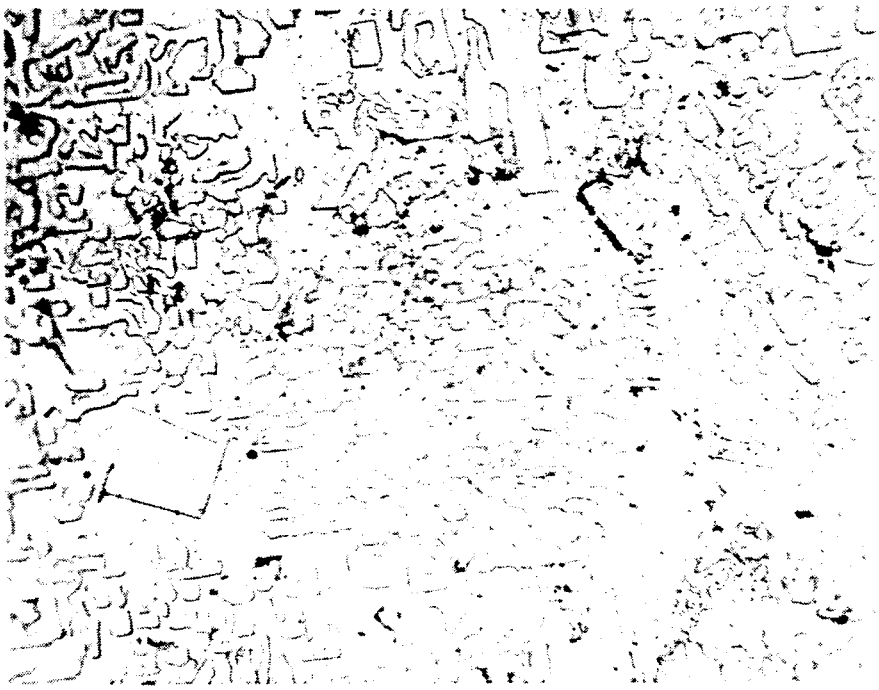
FIG. 5 is a photomicrograph of another preferred alloy of the present invention.

FIG. 5 shows the microstructure of another preferred alloy of the present invention which comprises 43% chromium, 2.02% carbon, 0.92 manganese, 1.44% silicon, 1.88% molybdenum, 1.92% nickel, 1.2% copper, the balance substantially iron. The microstructure in this case is hypereutectic with trace amounts of primary $M_7C_3$ carbides and a eutectic structure comprising eutectic carbides in a matrix of eutectic ferrite.

Any suitable conventional casting and heat treatment technology may be used to produce the alloys of the present invention. However, it is preferred that the alloys are formed by casting and then heat treating at a temperature in the range of 600° to 1000° C. followed by air cooling.

Many modifications may be made to the alloy described above without departing from the spirit and scope of the invention.

I claim:

1. An erosion and corrosion resistant ferrochromium alloy comprising the following composition, in wt. %.
34–50 chromium
1.5–2.3 carbon
up to 5 manganese
up to 5 silicon
up to 5 molybdenum
up to 10 nickel
up to 5 copper
up to 1% of each of one or more micro-alloying elements selected from the group consisting of titanium, zirconium, niobium, boron, vanadium and tungsten, and
balance, iron and incidental impurities, with a microstructure comprising eutectic chromium carbides in a matrix comprising one or more of ferrite, retained austenite and martensite, as herein defined.

2. The alloy defined in claim 1, wherein the microstructure further comprises one of chromium carbides, ferrite or austenite in the matrix.

3. The alloy defined in claim 1, wherein the matrix contains a 25–35 wt. % solid solution of chromium.

4. The alloy defined in claim 1 comprising in wt. %:
36–40 chromium
1.9–2.1 carbon
1–2 manganese
0.5–1.5 silicon
1–2 molybdenum
1–5 nickel
1–2 copper.

5. The alloy defined in claim 2 comprising in wt. %:
36–40 chromium
1.9–2.1 carbon
1–2 manganese
0.5–1.5 silicon
1–2 molybdenum
1–5 nickel 1–2 copper.

6. The alloy defined in claim 3 comprising in wt. %:
36–40 chromium
1.9–2.1 carbon
1–2 manganese
0.5–1.5 silicon
1–2 molybdenum
1–5 nickel
1–2 copper.

7. A method of producing an erosion and corrosion resistant ferrochromium alloy comprising the following composition, in wt. %,
34–50 chromium
1.5–2.3 carbon
up to 5 manganese
up to 5 silicon
up to 5 molybdenum
up to 10 nickel
up to 5 copper
up to 1% of each of one or more micro-alloying elements selected from the group consisting of titanium, zirconium, niobium, boron, vanadium and tungsten, and
balance, iron and incidental impurities, with a microstructure comprising eutectic chromium carbides in a matrix comprising one or more of ferrite, retained austenite and martensite, as herein defined,
the method comprising heat treating the alloy at a temperature in the range of 600°–1000° C., and air cooling the alloy.

8. The method defined in claim 7, wherein the microstructure of the alloy further comprises one of primary chromium carbides, primary ferrite or primary austenite in the matrix.

9. The method defined in claim 7, wherein the alloy matrix contains a 25–35 wt. % solid solution of chromium.

10. The method defined in claim 7, wherein the alloy comprises in wt. %:
36–40 chromium
1.9–2.1 carbon
1–2 manganese
0.5–1.5 silicon
1–2 molybdenum
1–5 nickel
1–2 copper.

11. The method defined in claim 8, wherein the alloy comprises in wt. %:
36–40 chromium
1.9–2.1 carbon
1–2 manganese
0.5–1.5 silicon
1–2 molybdenum
1–5 nickel
1–2 copper.

12. The method defined in claim 9, wherein the alloy comprises in wt. %:
36–40 chromium
1.9–2.1 carbon
1–2 manganese
0.5–1.5 silicon
1–2 molybdenum
1–5 nickel
1–2 copper.

* * * * *

UNITED STATES PATENT AND TRADEMARK OFFICE
CERTIFICATE OF CORRECTION

Reexamination
Certificate No. B1 5,252,149

DATED : Sep. 29, 1998

INVENTOR(S) : Kevin F. Dolman

It is certified that error appears in the above-identified patent and that said Letters Patent is hereby corrected as shown below:

Col. 1, line 18, "determiend" should be --determined--.

Col. 2, line 40 (Claim 43, line 8), "1-14 copper" should be --1-2 copper--.

Col. 2, line 45 (Claim 44, line 5), "maanganese" should be --manganese--.

Col. 3, line 66 (Claim 75, line 5), "present" should be --presence--.

Col. 4, line 18 (Claim 76, line 1), "metrix" should be --matrix--.

Col. 4, line 55 (Claim 79, line 23), "cooing" should be --cooling--.

Signed and Sealed this

Ninth Day of November, 1999

*Attest:*

Q. TODD DICKINSON

*Attesting Officer*

*Acting Commissioner of Patents and Trademarks*

US005252149B1

REEXAMINATION CERTIFICATE (3638th)

United States Patent [19]

Dolman

[11] B1 5,252,149

[45] Certificate Issued Sep. 29, 1998

[54] FERROCHROMIUM ALLOY AND METHOD THEREOF

[75] Inventor: Kevin F. Dolman, Helena Valley, Australia

[73] Assignee: Warman International Ltd., Artarmon, Australia

Reexamination Request:
No. 90/004,427, Oct. 25, 1996

Reexamination Certificate for:

| | |
|---|---|
| Patent No.: | **5,252,149** |
| Issued: | **Oct. 12, 1993** |
| Appl. No.: | **15,878** |
| Filed: | **Feb. 10, 1993** |

Related U.S. Application Data

[63] Continuation of Ser. No. 671,885, Apr. 3, 1991, abandoned.

[30] Foreign Application Priority Data

Aug. 4, 1989 [AU] Australia ..... PJ5628

[51] Int. Cl.[6] ..... C22C 38/36; C21D 6/00

[52] U.S. Cl. ..... 148/605; 148/422; 148/324; 148/611; 148/701

[58] Field of Search ..... 148/605, 422, 148/324, 611, 707; 420/441, 11, 12

[56] References Cited

U.S. PATENT DOCUMENTS

| | | | |
|---|---|---|---|
| 3,086,858 | 4/1963 | Edminster et al. | 75/128 |
| 4,080,198 | 3/1978 | Heyer et al. | 75/125 |
| 4,536,232 | 8/1985 | Khandros et al. | 148/35 |
| 4,929,288 | 5/1990 | Borges | 148/326 |

FOREIGN PATENT DOCUMENTS

| | | |
|---|---|---|
| 14453 | 11/1971 | Australia . |
| 43163 | 6/1972 | Australia . |
| 701807 | 12/1941 | Germany . |
| 2230864 | 12/1978 | Germany . |
| 55793 | 10/1935 | Norway . |
| 9526703 | 11/1996 | WIPO ..... 37/8 |

OTHER PUBLICATIONS

Craig I. Walker, A New Alloy For Phosphoric Acid Slurries (May 29, 1993).

Harry Tian, et al., Development of Corrosive Resistant White Irons For Use in Phos–Acid Service (May 25, 1996).

Warman Group Development, Technical Bulletin, vol. 19 (Feb. 1992).

Warman Group Development, Technical Bulletin, vol. 23 (Jan. 1994).

Kuttner, "Contribution to the Questions of the Corrosion Resistance of Iron–Chromium–Carbon Alloys", Technical Communication Krupp, Booklet 1 (1933), pp. 17–23.

Roesch, "High Alloy High Chromium Cast Iron as Material for the Chemical Industry", Die Chemische Fabrik (30) 26 (1933) pp. 317–324.

Roesch, "The Physical and Chemical Properties of High Alloy Chromium Cast Iron", Die GieBerie 23 (19) (1936) pp. 472–480.

*Shoaee*, "Corrosion Characteristics of Alloyed White Irons", Thesis presented to the Faculty of the Division of Graduate Students, Georgia Institute of Technology, Sep., 1983, Call No. TP172.G45 S518.

*Schulte*, "Properties and Application of Acid Resistant High Chromium–and Cast Chromium–Nickel–Cast Steel", Die GieBerie 26(19) (1939) pp. 477–484.

*Rabald*, "Alloy Cast Materials in Chemical Plant Equipment", Werkstoffe und Korrosion No. Aug. 9 (1956) pp. 435–448.

*Piwowarsky*, "High Quality Cast Iron", 2 Ed. (1958) pp. 637–643.

*Ritter*, "Corrosion Tables of Metallic Materials" (1958).

Metals Handbook, Bruce Bardes, Ed; vol. 1 (1978).

"Iron Castings Handbook", Charles F. Walton, Ed., (1981).

"Oxidation and Wear Resistant Cast Iron—With Addition of Nickel, Copper, and Calcium", Derwent publication No. SU–414326, Dolbenko et al.

*Kinzel* et al., "The Alloys of Iron and Chromium", vol. II, (1940).

*Primary Examiner*—Deborah Yee

[57] ABSTRACT

An erosion and corrosion resistant ferrochromium alloy comprising the following composition, in wt. %, 34-50 chromium, 1.5-2.5 carbon, up to 5 manganese, up to 5 silicon, up to 5 molybdenum, up to 10 nickel, up to 5 copper, up to 1% of each of one or more micro-alloying elements selected from the group consisting of titanium, zirconium, niobium, boron, vanadium and tungsten, and balance, iron and incidental impurities.

The alloy has a microstructure comprising eutectic chromium carbides in a matrix comprising one or more of ferrite, retained austenite and martensite, as herein defined. Optionally, the microstructure further comprises one of primary chromium carbides, primary ferrite or primary austenite in the matrix.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 3–12 is confirmed.

Claims 1, 2 are cancelled.

New claims 13–88 are added and determiend to be patentable.

*13. An erosion and corrosion resistant ferrochromium alloy comprising the following composition, in wt. %:*

*35.8–50 chromium*

*1.5–2.3 carbon*

*up to 5 managanese*

*up to 5 silicon*

*up to 5 molybdenum*

*up to 10 nickel*

*up to 5 copper*

*up to 1% of each of one or more micro-alloying elements selected from the group consisting of titanium, zirconium, niobium, boron, vanadium and tungsten, and balance, iron and incidental impurities, with a microstructure comprising eutectic chromium carbides in a matrix comprising one or more of ferrite, retained austenite and martensite, as herein defined.*

*14. The alloy of claim 13, wherein the matrix comprises at least 25 wt. % solid solution of chromium.*

*15. The alloy of claim 13, further comprising 1–5 wt. % nickel.*

*16. The alloy of claim 13, further comprising 5–10 wt. % nickel.*

*17. The alloy of claim 13, further having molybdenum present therein.*

*18. The alloy of claim 15, further having molybdenum present therein.*

*19. The alloy of claim 16, further having molybdenum present therein.*

*20. The alloy of claim 13, wherein carbon is present in the range of 1.5–2.1 wt. %.*

*21. The alloy of claim 13, wherein carbon is present in the range of 1.5–1.9 wt. %.*

*22. The alloy of claim 20, wherein nickel is present in the range of 1–5 wt. %.*

*23. The alloy of claim 20, wherein nickel is present in the range of 5–10 wt. %.*

*24. The alloy of claim 21, wherein nickel is present in the range of 1–5 wt. %.*

*25. The alloy of claim 21, wheren nickel is present in the range of 5–10 wt. %.*

*26. The alloy of claim 22, further having molybdenum present therein.*

*27. The alloy of claim 23, further having molybdenum present therein.*

*28. The alloy of claim 24, further having molybdenum present therein.*

*29. The alloy of claim 25, further having molybdenum present therein.*

*30. The alloy of claim 13, further comprising 40–50 wt. % chromium.*

*31. The alloy of claim 15, further comprising 40–50 wt. % chromium.*

*32. The alloy of claim 16, further comprising 40–50 wt. % chromium.*

*33. The alloy of claim 22, further comprising 40–50 wt. % chromium.*

*34. The alloy of claim 23, further comprising 40–50 wt. % chromium.*

*35. The alloy of claim 24, further comprising 40–50 wt. % chromium.*

*36. The alloy of claim 25, further comprising 40–50 wt. % chromium.*

*37. The alloy of claim 13, wherein at least one member selected from the group consisting of nickel, manganese, and copper is present in the alloy.*

*38. The alloy of claim 13, wherein at least two members selected from the group consisting of nickel, manganese, and copper are present in the alloy.*

*39. The alloy of claim 13, wherein nickel, manganese and copper are each present in the alloy.*

*40. The alloy of claim 13, wherein at least one element of said group of micro-alloying elements is present in said alloy.*

*41. The alloy of claim 40, wherein titanium is present as said at least one micro-alloying element.*

*42. The alloy of claim 40, wherein vanadium is present as said at least one micro-alloying element.*

*43. The alloy of claim 13, comprising in wt. %:*

*36–40 chromium*

*1.9–2.1 carbon*

*1–2 manganese*

*0.5–1.5 silicon*

*1–2 molybednum*

*1–5 nickel*

*1–14 copper.*

*44. An erosion and corrosion resistant ferrochromium alloy comprising the following composition, in wt. %*

*34–50 chromium*

*1.5–2.3 carbon*

*up to 5 maanganese*

*up to 5 silicon*

*up to 5 molybdenum*

*up to 10 nickel*

*up to 5 copper*

*up to 1% of each of one or more micro-alloying elements selected from the group consisting of titanium, zirconium, niobium, boron, vanadium and tungsten, and*

*balance, iron and incidental impurities, with a microstructure essentially free of sigma phase comprising eutectic chromium carbides in a matrix comprising one or more of ferrite, retained austenite and martensite, as herein defined.*

*45. The alloy of claim 44, wherein the matrix comprises at least 25 wt. % solid solution of chromium.*

*46. The alloy of claim 44, further comprising 1–5 wt. % nickel.*

*47. The alloy of claim 44, further comprising 5–10 wt. % nickel.*

*48. The alloy of claim 44, further having molybdenum present therein.*

*49. The alloy of claim 46, further having molybdenum present.*

*50. The alloy of claim 47, further having molybdenum present therein.*

*51. The alloy of claim 44, wherein carbon is present in the range of 1.5–2.1 wt. %.*

*52. The alloy of claim 44, wherein carbon is present in the range of 1.5–1.9 wt. %.*

*53. The alloy of claim 51, wherein nickel is present in the range of 1–5 wt. %.*

*54. The alloy of claim 51, wherein nickel is present in the range of 5–10 wt. %.*

*55. The alloy of claim 52, wherein nickel is present in the range of 1–5 wt.%.*

*56. The alloy of claim 52, wherein nickel is present in the range of 5–10 wt. %.*

*57. The alloy of claim 53, further having molybdenum present therein.*

*58. The alloy of claim 54, further having molybdenum present therein.*

*59. The alloy of claim 55, further having molybdenum present therein.*

*60. The alloy of claim 56, further having molybdenum present therein.*

*61. The alloy of claim 44, further comprising 40–50 wt. % chromium.*

*62. The alloy of claim 46, further comprising 40–50 wt. % chromium.*

*63. The alloy of claim 47, further comprising 40–50 wt. % chromium.*

*64. The alloy of claim 53, further comprising 40–50 wt. % chromium.*

*65. The alloy of claim 54, further comprising 40–50 wt. % chromium.*

*66. The alloy of claim 55, further comprising 40–50 wt. % chromium.*

*67. The alloy of claim 56, further comprising 40–50 wt. % chromium.*

*68. The alloy of claim 44, wherein at least one member selected from the group consisting of nickel, manganese, and copper is present in the alloy.*

*69. The alloy of claim 44, wherein at least two members selected from the group consisting of nickel, mangnese, and copper are present in the alloy.*

*70. The alloy of claim 44, wherein nickel, manganese and copper are each present in the alloy.*

*71. The alloy of claim 44, wherein at least one element of said group of micro-alloying elements is present in said alloy.*

*72. The alloy of claim 71, wherein titanium is present as said at least one micro-alloying element.*

*73. The alloy of claim 71, wherein vanadium is present as said at least one micro-alloying element.*

*74. The alloy of claim 44, comprising in wt. %:*

*36–40 chromium*

*1.9–2.1 carbon*

*1–2 manganese*

*0.5–1.5 silicon*

*1–2 molybdenum*

*1–5 nickel*

*1–2 copper.*

*75. An erosion and corrosion resistant ferrochromium alloy comprising the following composition, in wt. %:*

*34–50 chromium*

*1.5–2.3 carbon*

*the present of at least one element selected from the group consisting of manganese, nickel, and copper, wherein manganese, when present, will be in an amount up to 5%, wherein nickel, when present, will be in an amount up to 10%, and wherein copper, when present, will be in an amount up to 5%*

*up to 5 silicon*

*up to 5 molybdenum*

*up to 1% of each of one or more micro-alloying elements selected from the group consisting of titanium, zirconium, niobium, boron, vanadium and tungsten, and*

*balance, iron and incidental impurities, with a microstructure comprising eutectic chromium carbides in a matrix comprising one or more of ferrite, retained austenite and martensite, as herein defined, and*

*wherein the matrix contains at least about 25 wt. % solid solution of chromium.*

*76. The alloy of claim 75, wherein the metrix includes ferrite and austenite therein.*

*77. The alloy of claim 75, wherein the matrix contains a 25–35 wt. % solid solution of chromium.*

*78. The alloy of claim 75 comprising in wt. %:*

*36–40 chromium*

*1.9–2.1 carbon*

*1–2 manganese*

*0.5–1.5 silicon*

*1–2 molybdenum*

*1–5 nickel*

*1–2 copper.*

*79. A method of producing an erosion and corrosion resistant ferrochromium alloy comprising the following composition, in wt. %:*

*34–50 chromium*

*1.5–2.3 carbon*

*the presence of at least one element selected from the group consisting of manganese, nickel, and copper, wherein manganese, when present, will be in an amount up to 5%, wherein nickel, when present, will be in an amount up to 10%, and wherein copper, when present, will be in an amount up to 5%;*

*up to 5 silicon*

*up to 5 molybdenum*

*up to 1% of each of one or more micro-alloying elements selected from the group consisting of titanium, zirconium, niobium, boron, vanadium and tungsten, and*

*balance, iron and incidental impurities, with a microstructure comprising eutectic chromium carbides in a matrix comprising one or more of ferrite, retained austenite and martensite, as herein defined,*

*the method comprising heat treating the alloy at a temperature in the range of 600–1000 C., and air cooing the alloy.*

*80. The alloy of claim 79 comprising in wt. %:*

*36–40 chromium*

*1.9–2.1 carbon*

*1–2 manganese*

*0.5–1.5 silicon*

*1–2 molybdenum*

*1–5 nickel*

*1–2 copper.*

*81. The method defined in claim 7, wherein the alloy comprises 1–5 wt. % nickel.*

*82. The method of claim 7, wherein the alloy comprises 5–10 wt. % nickel.*

*83. The method defined in claim 7, wherein the alloy has molybdenum present therein.*

*84. The method as defined in claim 100, wherein the alloy has molybdenum present therein.*

*85. The method as defined in claim 101, wherein the alloy has molybdenum present therein.*

*86. The method as defined in claim 7, wherein the alloy comprises 35.8–50 wt. % chromium.*

*87. The method as defined in claim 7, wherein the alloy comprises 40–50 wt. % chromium.*

*88. The alloy of claim 1 wherein chromium is present in a range of 40–50 wt. %.*

* * * * *